US006264128B1

(12) United States Patent
Shampine et al.

(10) Patent No.: US 6,264,128 B1
(45) Date of Patent: Jul. 24, 2001

(54) LEVELWIND SYSTEM FOR COILED TUBING REEL

(75) Inventors: Rod W. Shampine, Houston; L. Michael McKee, Alvin; Joseph K. Flowers, Houston; Larry D. Welch, Missouri City; Terry L. McCafferty, Sugar Land, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/409,113

(22) Filed: Sep. 30, 1999

Related U.S. Application Data

(60) Provisional application No. 60/112,167, filed on Dec. 14, 1998.

(51) Int. Cl.[7] ..... B65H 27/00

(52) U.S. Cl. ..... 242/397.3; 242/157.1

(58) Field of Search ..... 242/397.3, 397.1, 242/397.2, 157 R, 157.1, 481; 166/77.2, 77.3, 384, 385, 85.5

(56) References Cited

U.S. PATENT DOCUMENTS

| | | | | |
|---|---|---|---|---|
| 3,367,602 | * | 2/1968 | Morling . | |
| 3,373,818 | | 3/1968 | Rike et al. . | |
| 3,614,019 | | 10/1971 | Slator . | |
| 4,005,834 | * | 2/1977 | Landreau . | |
| 4,148,445 | | 4/1979 | Reynolds et al. . | |
| 4,186,894 | * | 2/1980 | Brown | 242/397.1 |
| 4,421,284 | * | 12/1983 | Pan | 242/157.1 X |
| 4,513,772 | | 4/1985 | Fisher . | |
| 4,568,035 | * | 2/1986 | Ruch et al. | 242/397.2 X |
| 4,655,399 | | 4/1987 | Harvey . | |
| 4,838,302 | | 6/1989 | Prange . | |
| 4,848,697 | * | 7/1989 | Skalleberg | 242/157.1 X |
| 4,892,262 | * | 1/1990 | Hurst | 242/157.1 |
| 5,183,218 | | 2/1993 | Gavagna . | |
| 5,385,314 | * | 1/1995 | Hughes | 242/397.3 |
| 5,839,514 | * | 11/1998 | Gipson | 166/77.2 X |
| 5,865,392 | * | 2/1999 | Blount et al. | 242/157.1 X |

* cited by examiner

*Primary Examiner*—William A. Rivera
(74) *Attorney, Agent, or Firm*—Maryam Bani-Jamali; John J. Ryberg

(57) ABSTRACT

A levelwind system for a coiled tubing reel (26) including an arcuate guide arm (48) extending over the upper surface of the reel (26). A universal joint (50) mounts the lower end of the arm (48) for pivotal movement both vertically and horizontally. A guide member (52) is supported on the free end of the guide arm (48) for guiding the coiled tubing T on and off reel (26). A lift cylinder (54) is effective to raise and lower guide arm (48). A balancing cylinder (60) is effective for moving guide arm ME (48) laterally. A hydraulic fluid circuit responsive to a position sensor (111) and a microprocessor (112) as shown in FIG. 12 is effective for controlling the movement of the coiled tubing guide arm (48).

10 Claims, 8 Drawing Sheets

FIG. 10
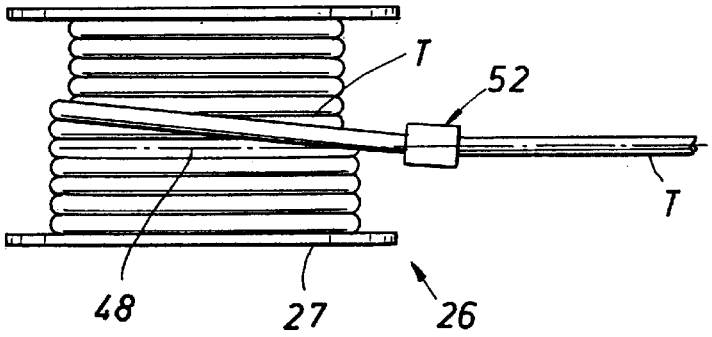
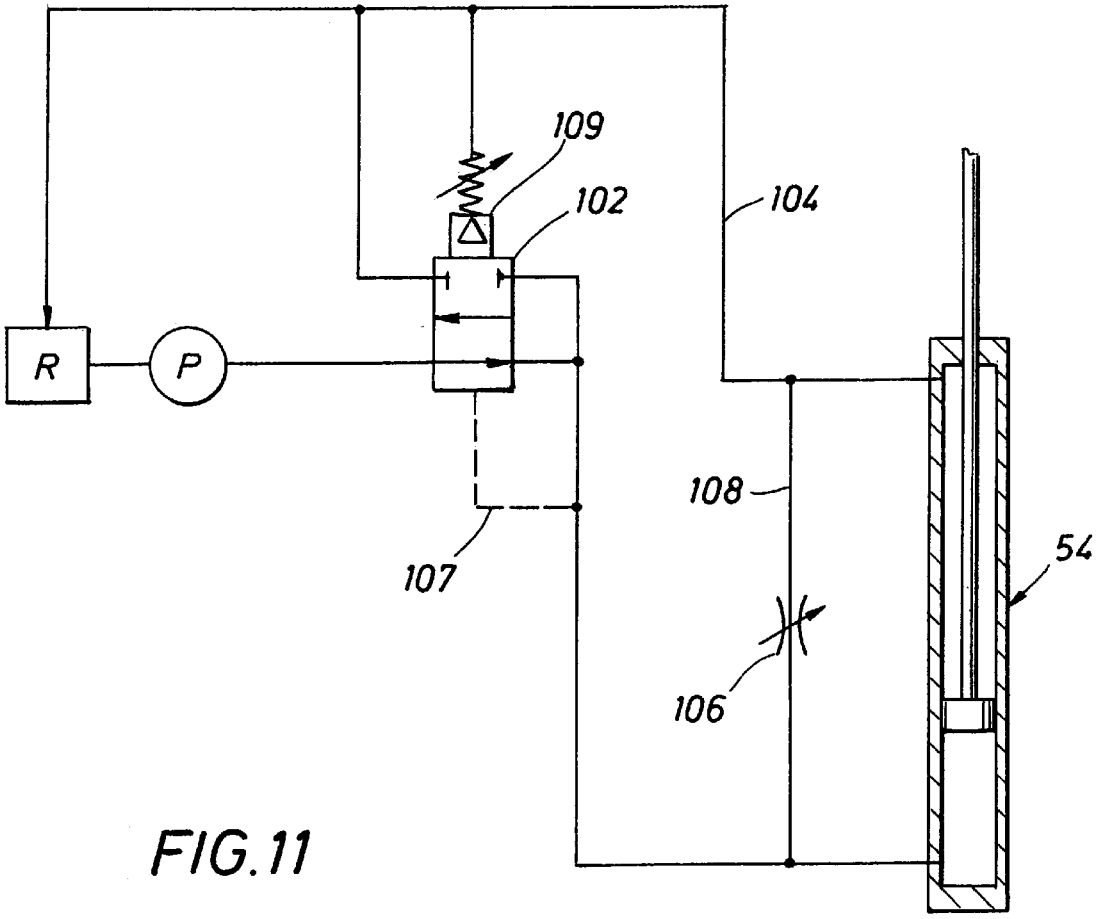
FIG. 11

LEVELWIND SYSTEM FOR COILED TUBING REEL

REFERENCE TO RELATED PROVISIONAL APPLICATION

This application claims the benefit of U.S. Provisional Application Ser. No. 60/112,167 filed Dec. 14, 1998.

FIELD OF THE INVENTION

A levelwind system for a coiled tubing reel to guide coiled tubing onto a reel when the coiled tubing is removed from an oil or gas well and to guide the coiled tubing from the reel when the coiled tubing is injected into an oil or gas well.

BACKGROUND OF THE INVENTION

Heretofore, levelwind systems have been provided for wrapping or spooling coiled tubing onto a reel when the coiled tubing is removed from a well. Drive means are provided for rotation of the reel and the levelwind systems utilized heretofore have been mechanically or hydraulicly driven by rotation of the reel. Many prior art levelwind systems use a levelwind screw to move a tubing guide laterally across the reel in order to properly wrap the tubing. The screw is turned at a rate proportional to the rate of reel rotation in order that the tubing guide may move at approximately the rate of the current wrap position. The height of the tubing guide (as well as the threaded rod) is controlled by a hydraulic lifting mechanism, which in turn is controlled by the unit operator, who must determine an optimal height to transmit vertical forces which support the tubing properly. This lifting mechanism is typically pinned at or near the rotational axis of the reel, and requires package space outside the flanges of the reel.

Another system uses a chain loop between the sides or flanges of the reel to function in a manner similar to the levelwind screw. A further system moves the entire reel laterally to wrap the tubing onto the reel. The levelwind systems utilized heretofore require some connection or association with the reel drive system and to the reel supporting structure on opposed sides of the reel. Further, a predetermined controlled force is not applied to the coiled tubing by prior systems to minimize reverse bending of the coiled tubing. Also, the levelwind or guide head receiving the coiled tubing is not continually adjusted automatically in a vertical direction. A mechanical change is required in order to modify such a levelwind system for coiled tubing having different diameters.

SUMMARY OF THE INVENTION

The present invention is particularly directed to a levelwind system for wrapping coiled tubing onto a reel when the coiled tubing is removed from an oil or gas well without being connected to the reel drive means in any manner. The levelwind system includes a single guide arm having a lower end mounted about a universal joint on a supporting structure at a position outside the reel and preferably between opposed sides or flanges of the reel. The arm is supported vertically by a so-called lift cylinder effective to provide a constant predetermined pressure on the arm and to move the arm in a vertical direction. A fluid circuit for the lift cylinder provides a constant vertical force on the coiled tubing guide regardless of its location.

A second fluid cylinder comprises a so-called balancing cylinder and is connected at one end to the arm to move the arm side ways from side to side of the reel and mounted at an opposed end to a supporting structure. The coiled tubing guide on an upper free end of the arm supports the coiled tubing being wound on the reel and is positioned at coordinates defined by a vertical angle and transverse angle at right angles to the vertical angle.

Levelwinding is accomplished by sensing the motion of the reel and moving the upper free end of the guide arm. A fluid regulator valve is utilized to move the balancing cylinder which in turn moves the guide arm a horizontal distance proportional to the motion of the reel and the size of the tubing. Manual control is provided by directly controlling the regulator valve. Vertical motion to accommodate various entry angles and tubing tensions is automatically accomplished as the guide arm moves vertically to maintain a constant upward force on the tubing. By disconnecting the levelwind arm from the coiled tubing, the arm may swing upwardly to a vertical relation allowing the reel to be removed and replaced using a simple vertical lift. The coiled tubing guide arm is not connected to the reel drive system and can easily be moved to a fully vertical position to permit the reel to be removed.

A position sensor for the guide arm is positioned in the balancing cylinder and feedback signals from the position sensor are received by a CPU which processes such input signals and then transmits output signals to solenoid operated regulator valves for positioning the balancing cylinder at a desired lateral position relative to the reel. The balancing cylinder is effective to move the free end of the arm having the coiled tubing guide thereon for positioning the coiled tubing being wound on the reel at a predetermined location. A manual override is provided for manual control of the balancing cylinder, if desired. Also, a manual override is provided for the lift cylinder.

An object of the present invention is to provide a levelwind system for a coiled tubing reel which is independent of the drive mechanism for rotation of the coiled tubing reel.

Another object of the invention is to provide such a levelwind system is which a guide member is mounted at its lower end to a supporting structure adjacent the reel and extends over the reel for guiding coiled tubing on and off the reel.

A further object of the invention is to provide a coiled tubing guide member mounted for movement both vertically and horizontally for positioning the upper free end of the guide member at a desired position relative to the coiled tubing reel.

An additional object is the provision of fluid cylinders for positioning of the guide member at a predetermined position including a lift cylinder for raising and lowering the guide member and a balancing cylinder for lateral movement of the guide member.

Another object is the provision of fluid pressure regulator means for such fluid cylinders including a position sensor for the guide member and a computer processing unit responsive to the position sensor controlling movement of the cylinders for positioning of the guide arm at a desired position and a desired force.

Other features and advantages of the invention are apparent from the following specification and drawings.

BRIEF DESCRIPTION OF THE DRAWINGS

FIG. 10 is a schematic view of the winding of the coiled tubing onto the reel with the coiled tubing guide positioned about two wraps laterally of the current wrap to provide a tight wrapping of the coiled tubing;

FIG. 11 is a schematic view of the hydraulic fluid system for controlling the lift cylinder.

BRIEF DESCRIPTION OF THE INVENTION

Figure 1:
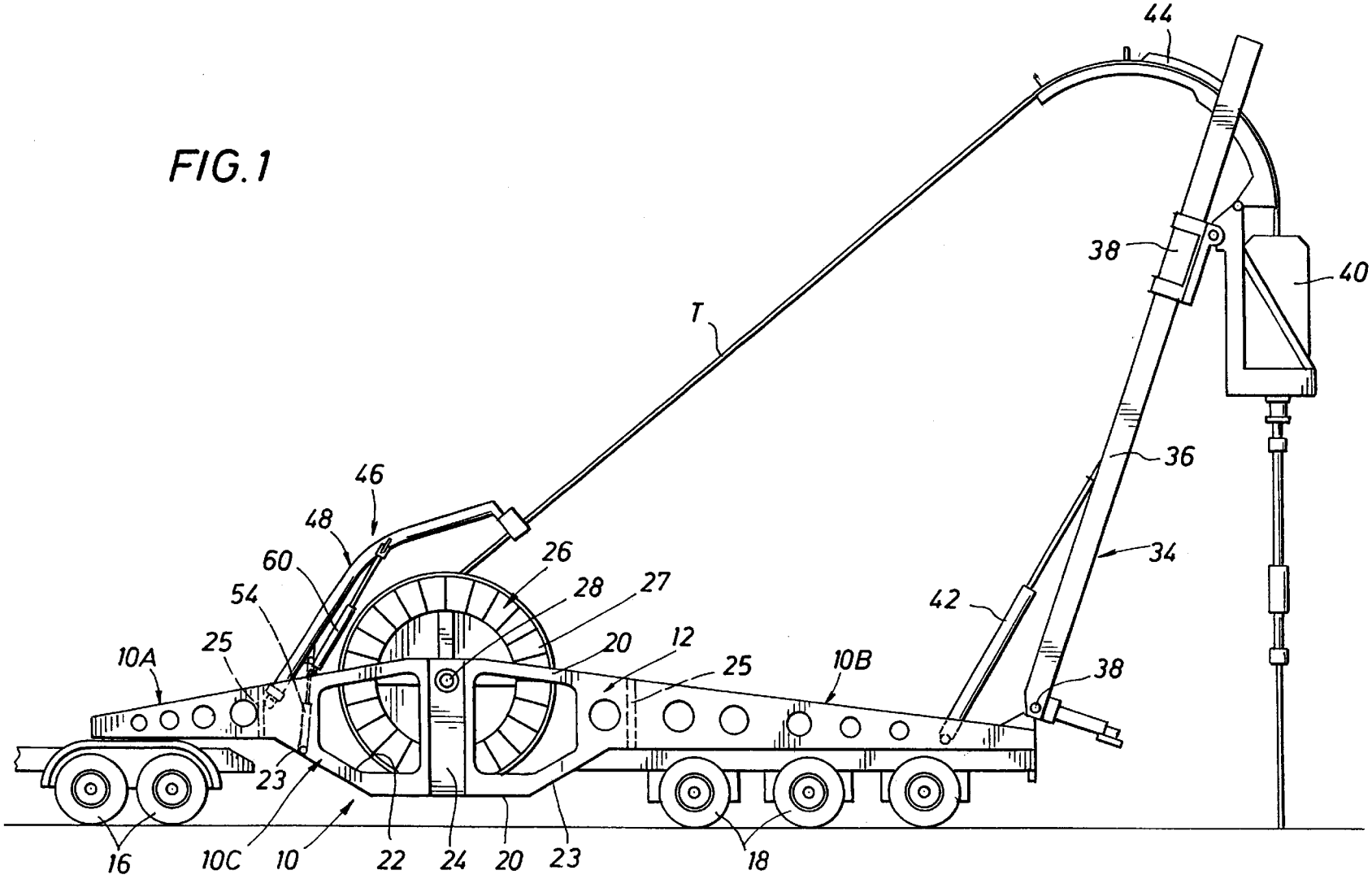
FIG. 1 is a side elevation of the levelwind apparatus mounted on an over the road trailer and showing a coiled tubing injector in operable position for inserting coiled tubing within a surface wellhead.
Figure 2:
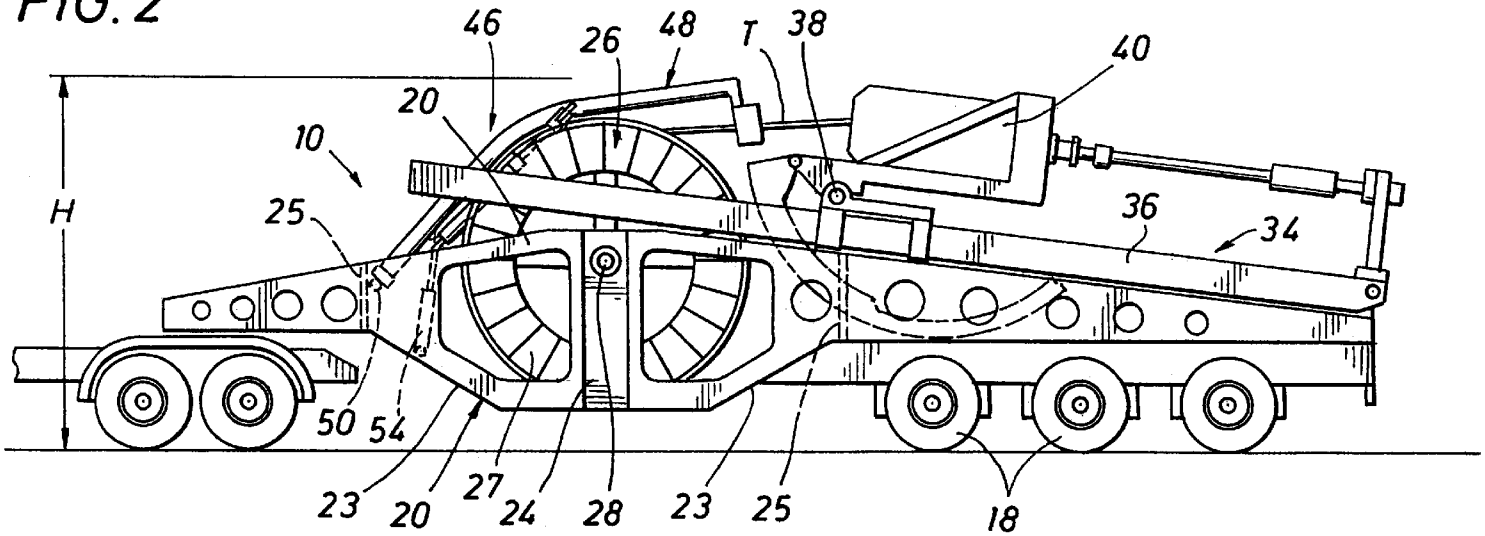
FIG. 2 is a side elevation similar to FIG. 1 but showing the coiled tubing injector in a stored position on the trailer projecting a minimal height above the trailer and adapted for over the road travel.
Figure 3:
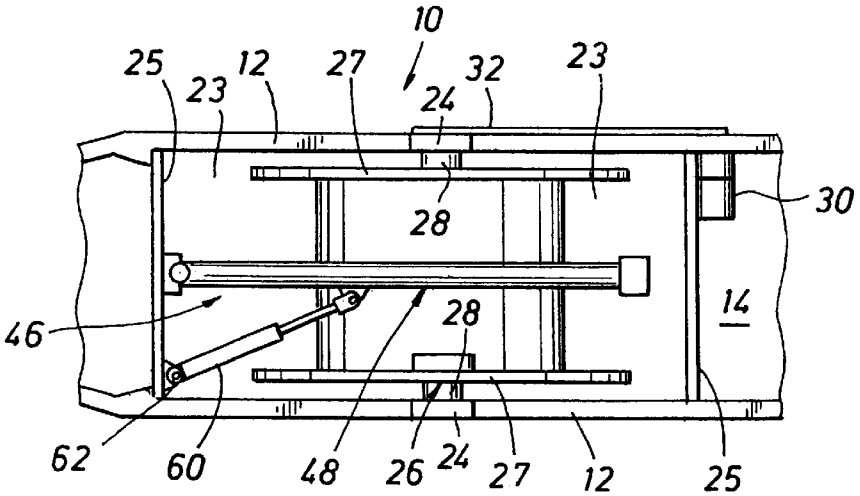
FIG. 3 is a top plan of the levelwind apparatus shown in FIGS. 1 and 2 showing the levelwind arm over the coiled tubing reel for the coiled tubing.

Referring to FIGS. 1–3, an over the road trailer is shown at 10 having a pair of side frames 12 extending the length of the trailer 10 and a lower deck or floor 14 extending between side frames 12. Trailer 10 includes a front end section 10A, a rear end section 10B, and a dropped center section 10C between end sections 10A and 10B. Tractor 16 supports end section 10A while trailer wheels 18 support end section 10B for over the road travel. Side frames 12 include upper and lower sill or frame members 20. Dropped center section 10C extends below the upper surface of tractor 16 wheels and trailer wheels 18 to form a well 22. Floor 14 includes inclined floor portions 23 at well 22. Vertical struts 24 extend upwardly from well 22 and are connected between upper and lower frame members 20. Transverse stiffeners or partitions 25 extend between side frames 12 at opposed ends of well 22.

A coiled tubing reel 26 having spaced end flanges 27 is supported on bearings 28 on struts 24 for rotation and is received within well 22 for projecting a minimal height above the roadway surface. A hydraulic motor 30 is connected to reel 26 by sprockets and a sprocket chain 32 for rotating reel 26 as shown in FIG. 2.

A mast generally indicated at 34 includes a pair of parallel posts 36 pivotally mounted at 38 on the rear end of trailer 10 and a trolley or carriage 38 has an injector head 40 pivotally mounted thereon. Cylinders 42 are provided for pivotal movement of mast 34 between an operable position as shown in FIG. 1 and a stored position for over the road travel in FIG. 2 with posts 36 fitting alongside end flanges 27 of reel 26. A gooseneck 44 is also mounted on carriage 38. Carriage 38 is mounted for travel along posts 36. As shown in FIG. 2 in the stored position of the coiled tubing rig for over the road transport, the total projecting height H of the stored rig from the roadway surface is less than 13 1/2 feet which is required by regulations for over the road travel.

Figures 7, 8, 9:
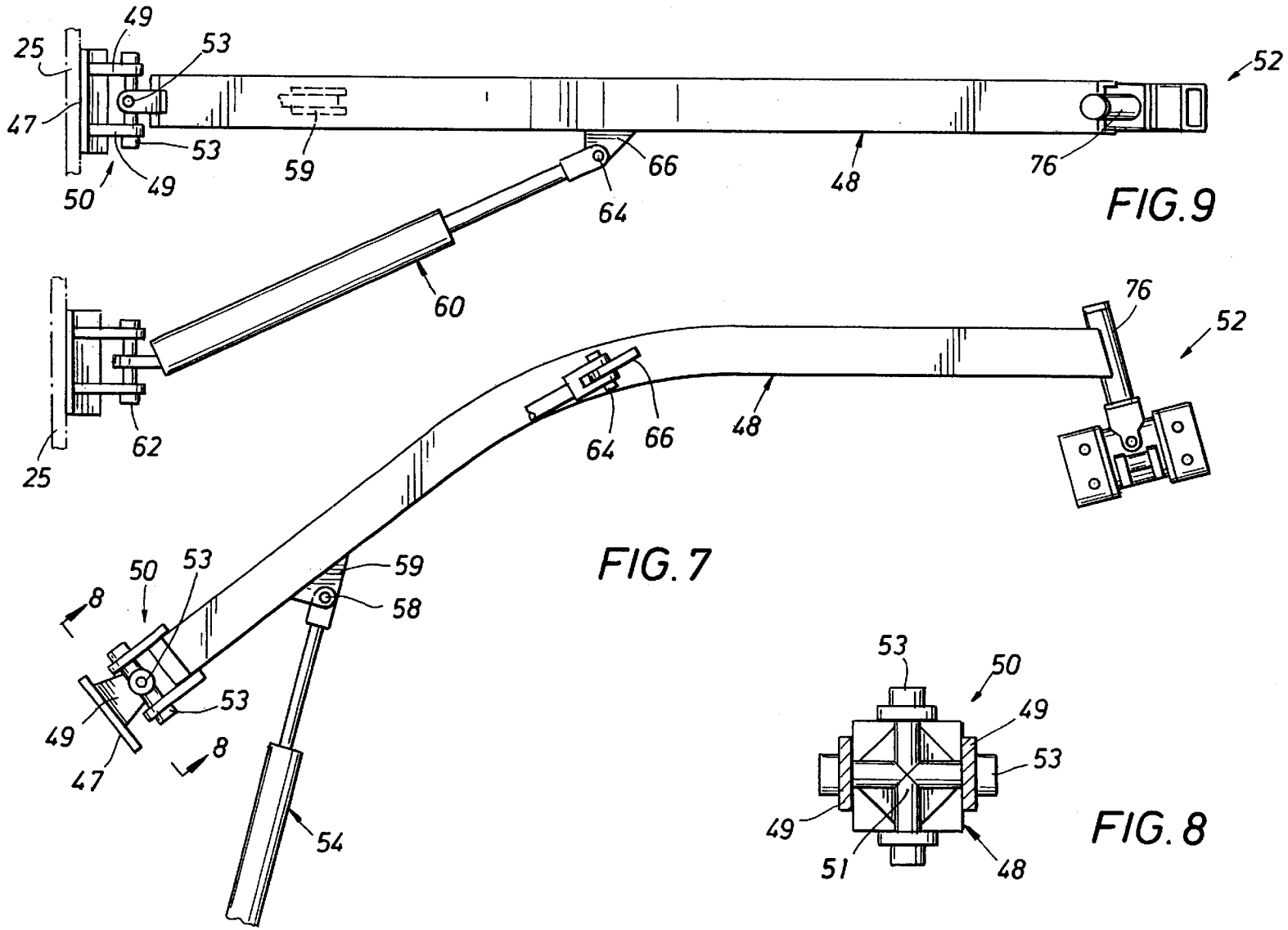
FIG. 7 is an enlarged side elevational view of the levelwind arm showing a lift cylinder attached thereto for raising and lowering of the arm about a universal joint for pivotal movement.
FIG. 8 is a view taken generally along the line 8—8 of FIG. 7 and showing the universal joint for mounting the lower end of the levelwind arm.
FIG. 9 is a top plan of a levelwind arm showing the balancing cylinder pivotally mounted adjacent a side of the levelwind arm for movement of the arm horizontally to a desired position to permit a predetermined horizontal force to be applied against the guide arm.

Coiled tubing T which is unreeled from reel 26 is guided downwardly by gooseneck 44 within injector head 40 for injection within a surface wellhead. Coiled tubing T being withdrawn from the wellhead is wrapped or reeled onto reel 26 and guided by gooseneck 44 to reel 26. For guiding coiled tubing T onto reel 26 when the coiled tubing is withdrawn from the well and for guiding the coiled tubing T when injected within the well, a levelwind apparatus comprising the present invention is shown generally at 46. Levelwind apparatus or mechanism 46 is effective to guide coiled tubing T between gooseneck 44 and reel 26 in addition to applying a force against tubing T for a winding of coiled tubing T onto reel 26 and for unwinding of coiled tubing T from reel 26. Levelwind apparatus 46 includes a bowed or arcuate arm generally indicated at 48 for extending over the upper surface of reel 26. Referring particularly to FIGS. 7–9, a mounting means generally indicated at 50 mounts the lower end of arm 48 for pivotal movement. Mounting means 50 includes a mounting plate 47 secured to partition 25 and having a pair of extending spaced arms 49. A universal joint 51 having pivots 53 is positioned between guide arm 48 and arms 49 to permit movement of guide arm 48 both vertically and horizontally. The extending free end of arm 48 has guide means generally indicated at 52 for receiving and guiding the movement of coiled tubing T between reel 26 and gooseneck 44. For movement of arm 48 in a generally vertical plane, a lift cylinder 54 is pivotally connected adjacent its lower end at 56 to inclined deck portion 23 of trailer 10. The upper end of lift cylinder 54 is connected at 58 to a bracket 59 on arm 48.

For lateral movement of guide arm 48 and to exert a lateral force against coiled tubing T, a balancing cylinder 60 is pivotally connected adjacent its lower end at 62 to partition 25 of trailer 10 adjacent one end of partition 25. The upper end of balancing cylinder 60 is connected at 64 to bracket 66 on arm 48.

Figure 4:
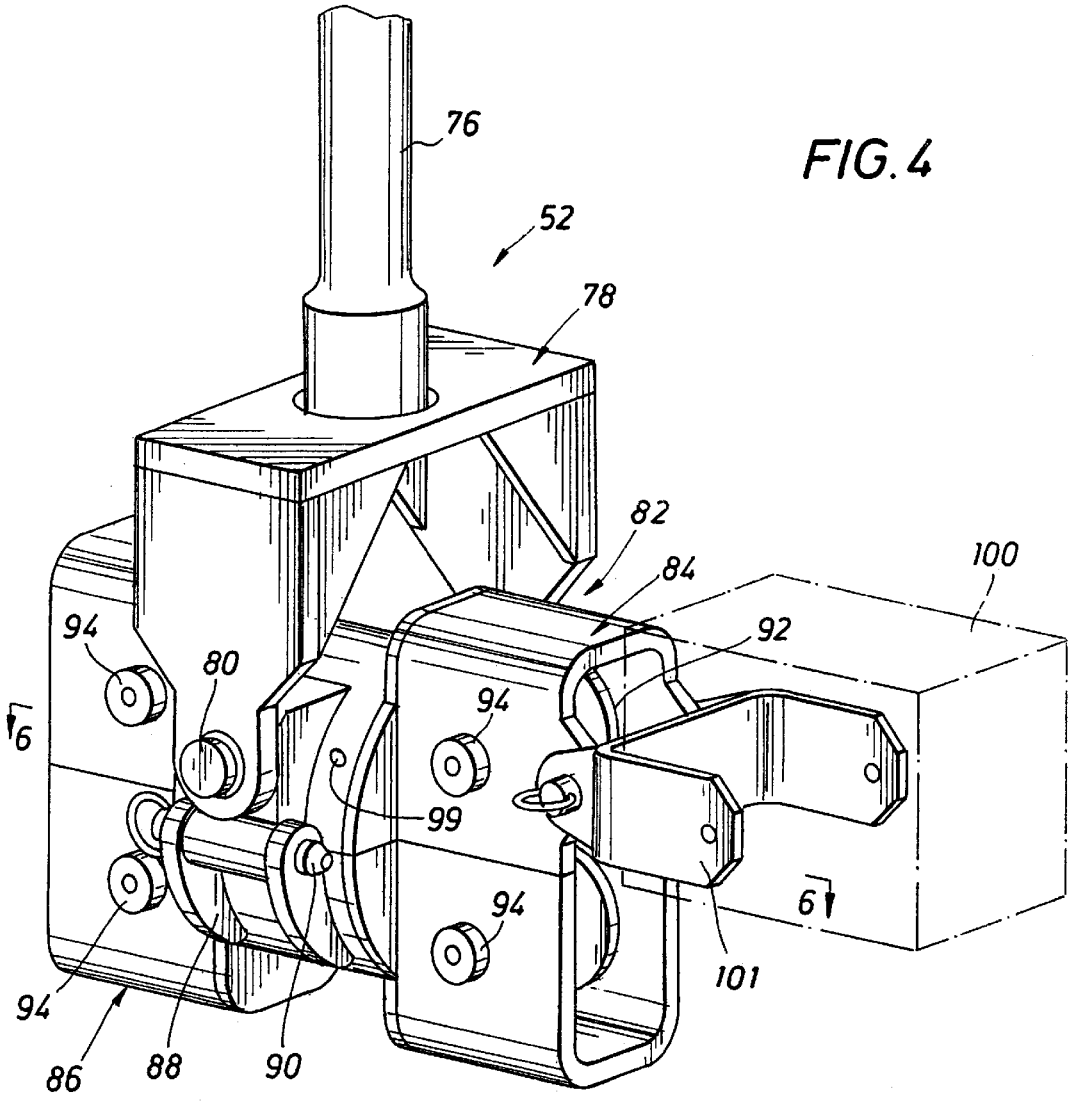
FIG. 4 is a perspective view of the coiled tubing guide mechanism supported on the free end of the levelwind arm for receiving and guiding the reeling and unreeling of the coiled tubing for the coiled tubing reel.
Figure 6:
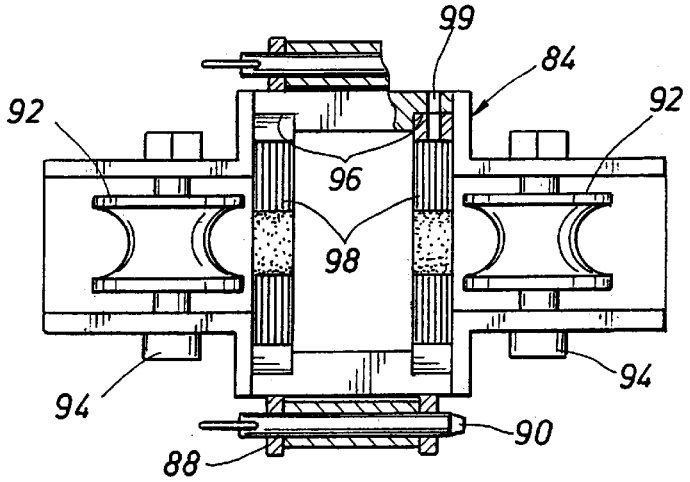
FIG. 6 is a view taken generally along line 6—6 of FIG. 4 and showing a lubricant applicator for the lower body section for applying lubricant to the coiled tubing as it moves through the guide structure.
Figure 5:
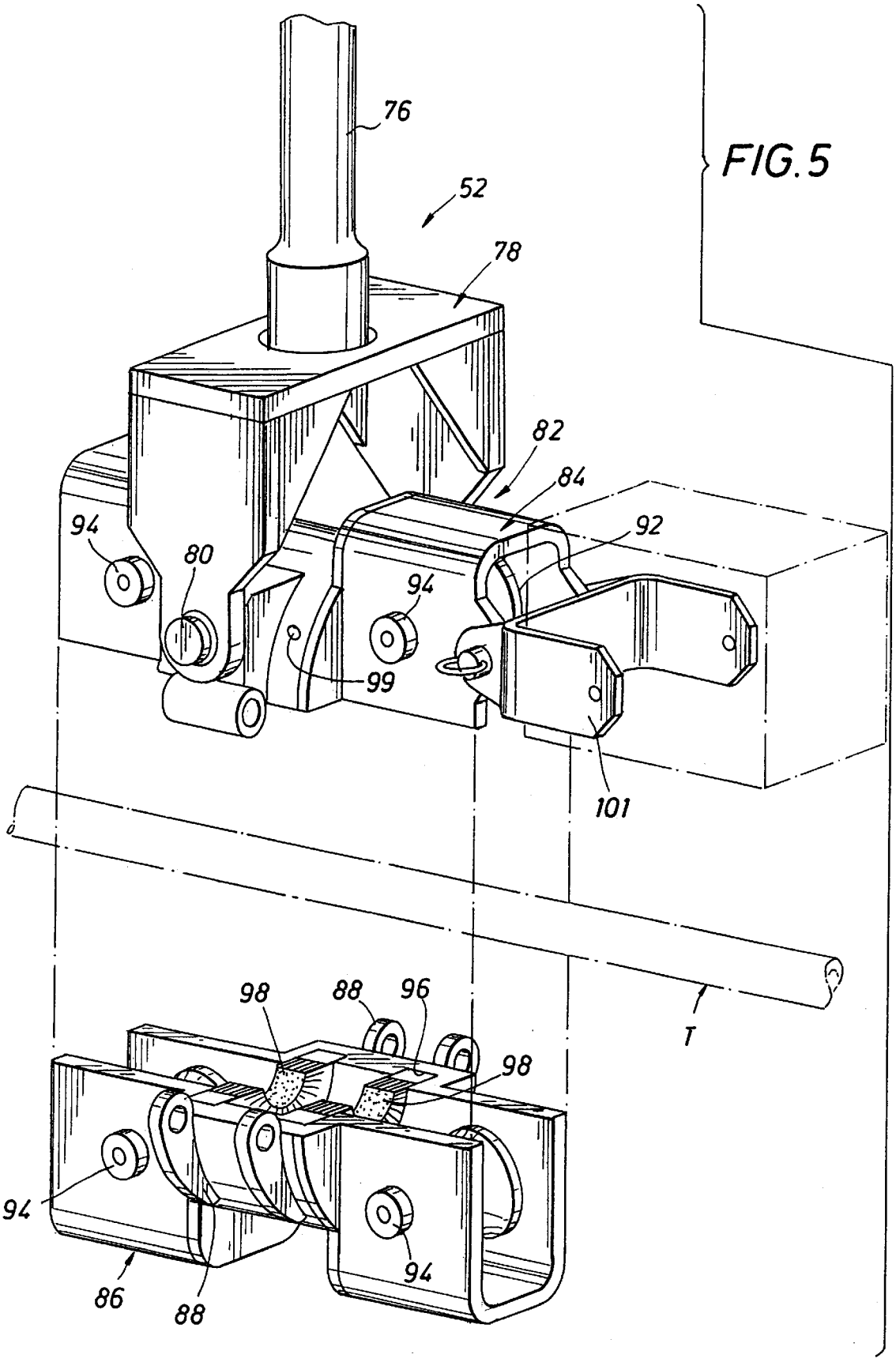
FIG. 5 is a perspective view similar to FIG. 4 but showing a lower body section of the guide mechanism removed from the upper body section for positioning of the coiled tubing therein.

Referring particularly to FIGS. 4–6, guide means 52 on the free end of arm 48 extending over the upper surface of reel 26 is provided including a rod 76 secured to arm 48 and having a lower end received within a clevis 78 pivotally mounted at 80 to the guide body indicated generally at 82. Guide body 82 includes two body sections or halves 84, 86 connected together by hinges 88 and pull pins 90. Each body section 84, 86 has a pair of rollers 92 mounted by removable pins 94 within sections 84, 86 for removal and replacement with different size rollers thereby to modify guide means 52 for coiled tubing T having different outer diameters such as 1¼, 1½, and 1¾ inches. As shown in FIGS. 5 and 6, each body half or section 84, 86 has a pair of spaced parallel semicircular grooves 96 thereon. Semicircular cleaning and lubricant brushes 98 are mounted in grooves 96 and contact the outer surface of tubing T when tubing T is moving through guide means 52 for cleaning and lubricating the outer surface of tubing T. Lubricant openings 99 are provided for lubrication of brushes 98. For threading tubing T through guide means 52, pins 90 are withdrawn for removal of lower half 86. Then, coiled tubing T is positioned against rollers 92 in upper body half 84. Thereafter rollers 92 in lower half 86 are pressed against coiled tubing T and pins 90 are inserted to connect body sections 84, 86. Semicircular brush segments 98 are inserted within grooves 96 in lower body section 86 before connection of body sections 84, 86. A bracket 101 on upper body section 84 supports a measuring instrument 100 for measuring the ovality of coiled tubing T.

Referring to FIG. 10, coiled tubing T is shown schematically being wrapped or wound on reel 26 and guide means 52 on arm 48 is shown as forcing coiled tubing T laterally over about two wraps from the wrap being made. Thus, a tight uniform winding of coiled tubing T onto reel 26 is provided by forcing guide arm 48 and guide 52 against coiled tubing T under a predetermined force.

For controlling the vertical movement of guide arm 48 and guide means 52 thereon, reference is made to FIG. 11 in which pressurized fluid from pump P and reservoir R is supplied to lift cylinder 54 through two way valve 102. A return line 104 to reservoir R returns fluid from cylinder 54. An orifice 106 in bypass line 108 permits a small continuous return of fluid to reservoir R. Upon the reaching of a predetermined fluid pressure in lift cylinder 54, fluid through line 107 actuates valve 102 to move valve 102 to a position to permit return of fluid through line 104 to reservoir R. When the fluid pressure is reduced to an amount at which valve 102 is set by pressure control 109, valve 102 returns to the position shown in FIG. 11. Thus, the fluid pressure in cylinder 54 is maintained at a predetermined level.

Figure 12:
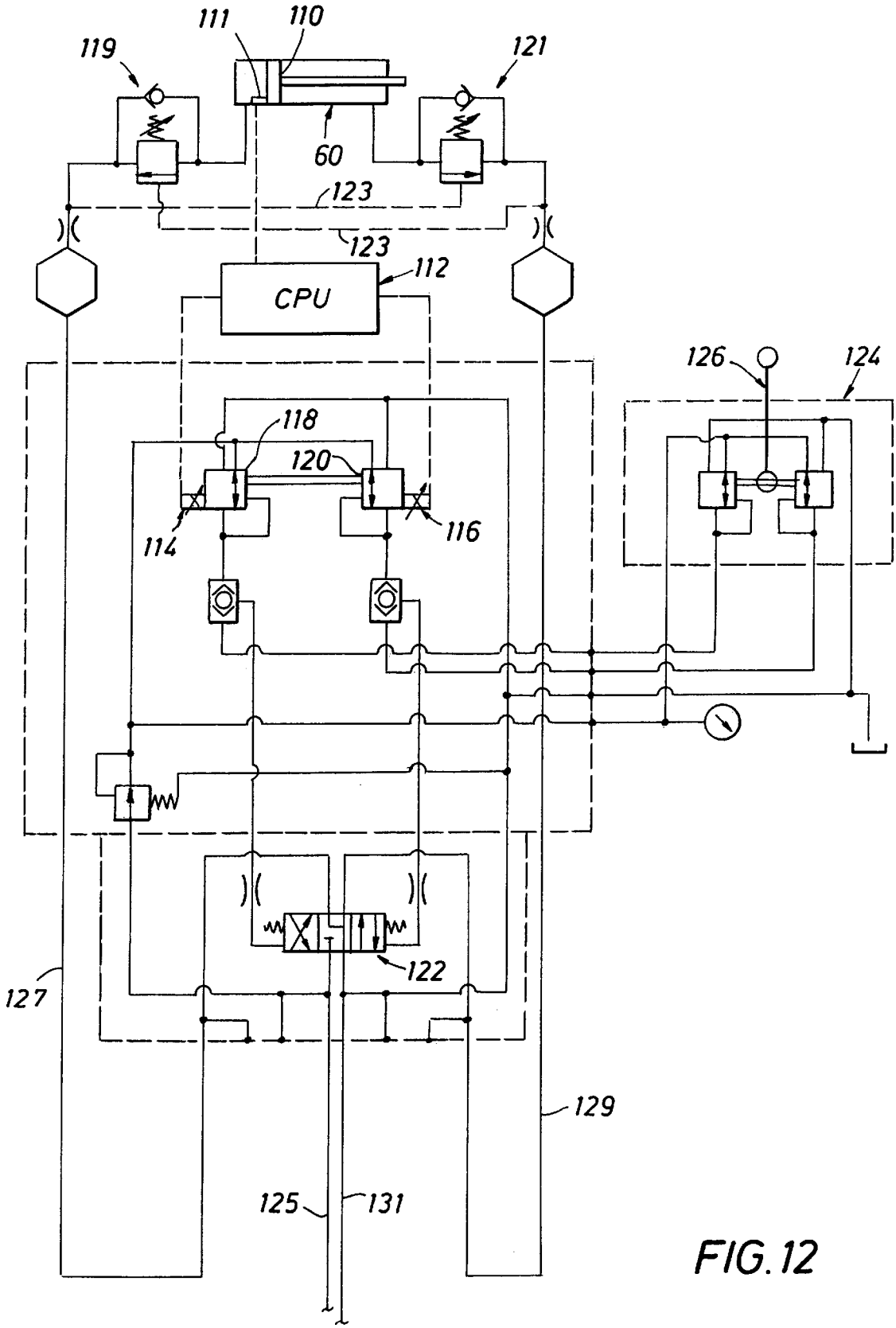
FIG. 12 is a schematic view of the hydraulic fluid system for controlling the balancing cylinder.

Referring to FIG. 12, the hydraulic fluid system for balancing cylinder 60 is illustrated schematically for moving cylinder 60 in a horizontal direction under a predetermined force level. The position of piston 110 is sensed by a position sensor 111 within cylinder 60 and signals are transmitted to a central processing unit (CPU) 112. CPU 112 processes signals from position sensor 111 against predetermined parameters for the desired position and force level of guide arm 48. Horizontal movement of guide arm 48 is controlled by signals transmitted from CPU 112 to solenoids 114 and 116 controlling the operation of solenoid operated regulator valves 118 and 120 for movement of guide arm 48 to a desired horizontal position. When wrapping or winding coiled tubing T onto reel 26 it is desired that a tight wrap be obtained and for that purpose guide means 52 on the free extending end of guide arm 48 is positioned laterally inwardly of the wrap being formed about one to four wraps for best results as shown schematically in FIG. 9.

A three-position, four-way valve 122 is controlled by solenoid operated valves 118, 120 to supply fluid selectively to opposed sides of piston 110 for movement of guide arm 48 laterally. Counterbalance valves 119 and 121 having sensing lines 123 are utilized to maintain piston 110 in position when hydraulic pressure is removed. Upon energizing of solenoid 116 fluid is supplied from line 125 through line 127 to one side of piston 110. Upon energizing of solenoid 114 fluid is supplied from line 125 through line 129 to the other side of piston 110. A return line 131 extends to a suitable reservoir. A manual override is shown generally at 124 and includes a manually operated lever 126 for actuation of piston 110 to effect lateral movement of guide arm 48.

Figure 13:
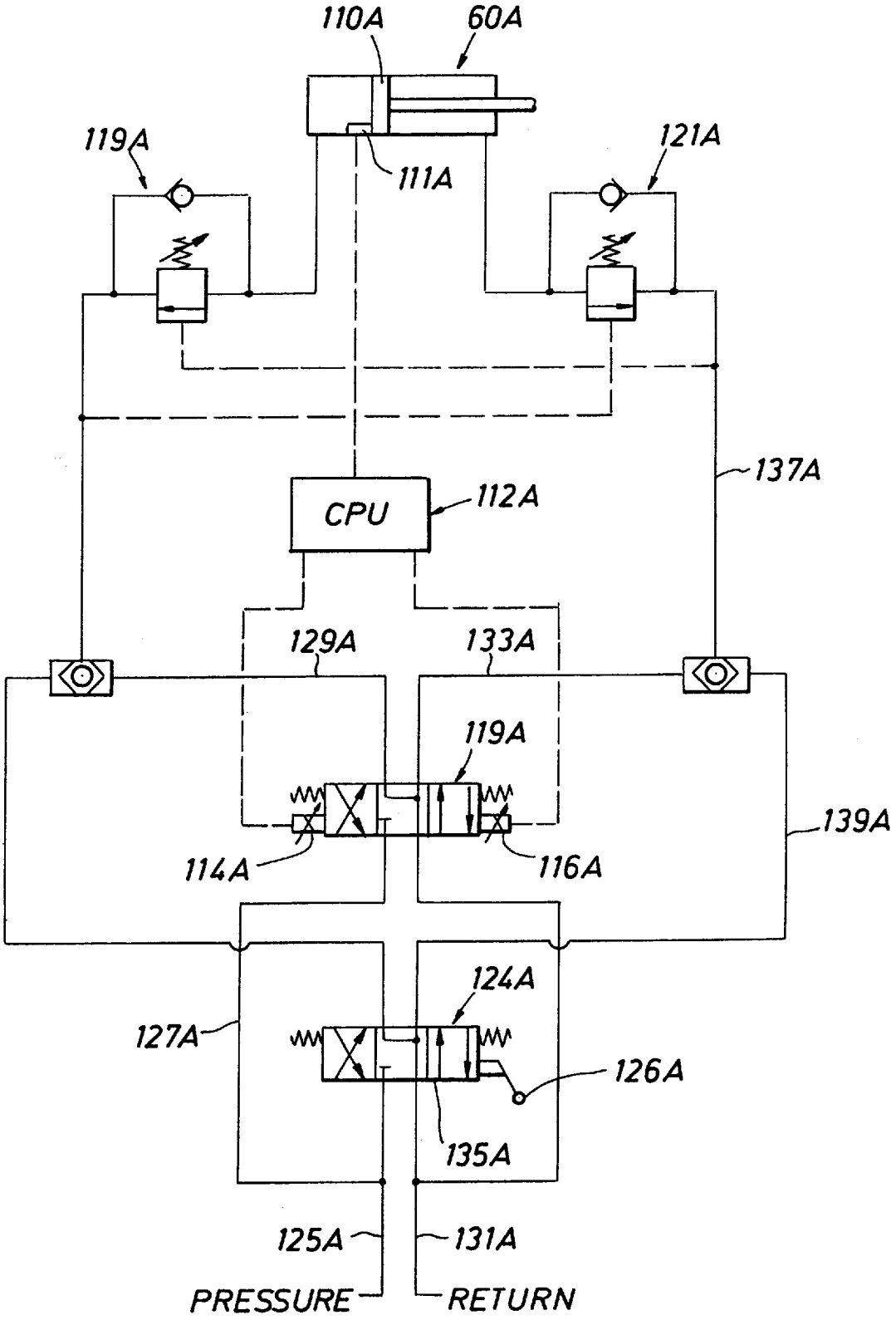
FIG. 13 is a schematic view of an alternative fluid system for controlling the balancing cylinder.

A modified fluid system is shown in FIG. 13 which may be substituted for the fluid system shown in FIG. 12. Balancing cylinder 60A has a piston 110A and a position sensor 111A with signals transmitted to CPU 112A. Counterbalance valves 119A and 121A maintain piston 110A in position when hydraulic pressure is released. A solenoid operated three-position, four-way valve 119A is shown with solenoids 114A and 116A adjacent valve 119A. Signals are transmitted by CPU 112A to solenoids 114A and 116A to control the operation of three way valve 119A for movement of guide arm 48 to a desired horizontal position. Upon energizing of solenoid 114A by signals from CPU 112A, fluid is supplied from supply line 125A through lines 127A and 129A to move piston 110A to the right as viewed in FIG. 13. Upon energizing of solenoid 116A, fluid is supplied through lines 125A and 133A to cylinder 60A to urge piston 110A to the left as viewed in FIG. 13.

The manual override shown at 124A comprises a three-position, four-way valve 135A having a manually operated handle 126A. Valve 135A may be operated manually to supply fluid to the desired side of piston 110A for movement of guide arm 48 to a desired position.

While the fluid diagrams shown in FIGS. 11, 12 and 13 have been illustrated as hydraulic fluid diagrams for hydraulic cylinders, other fluid systems, such as pneumatic systems may be utilized. Also, while hydraulic cylinders 54 and 60 have been illustrated in the drawings as controlling the movement and force levels of guide arm 48 and coiled tubing guide 52, it is to be understood that various other mechanisms could be utilized for movement of guide arm 48 independent of the drive means for coiled tubing reel.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A coiled tubing reel structure comprising:

a coiled tubing reel mounted for rotation about a horizontal axis;

drive means for rotating said coiled tubing reel;

a coiled tubing guide member adjacent said reel for guiding coiled tubing onto said reel; and positioning means for said guide member independent of said drive means for positioning said guide member at a predetermined position relative to said coiled tubing reel said positioning means including a first fluid cylinder operatively connected to said guide member for moving said guide member in a generally vertical direction and a second fluid cylinder operatively connected to said guide member for moving said guide member in a generally horizontal direction between opposed ends of said reel.

2. A coiled tubing reel structure as set forth in claim 1 wherein said guide member comprises a guide arm of a generally arcuate shape for extending over said reel from a supporting structure; and a mounting device on said supporting structure supports said guide arm for pivotal movement.

3. A levelwind apparatus for guiding coiled tubing onto a reel for wrapping the coiled tubing, said apparatus comprising:

a guide arm having an upper end thereof extending adjacent the reel from a side thereof and a coiled tubing guide mounted adjacent said upper end arranged for guiding coiled tubing onto the reel; and force exerting means, including a first and a second fluid cylinder operatively connected to said arm, for moving said upper end of said arm in a generally vertical direction relative to said reel by the first fluid cylinder and in a generally horizontal direction between ends of said reel for guiding the coiled tubing onto said reel.

4. The levelwind apparatus as set forth in claim 3 wherein said arm is of a generally arcuate shape for extending over said reel from a supporting structure; and a mounting device on said supporting structure supports said arm for pivotal movement.

5. The levelwind apparatus as set forth in claim 4 wherein said reel includes a pair of end flanges forming the ends of the reel and a gooseneck is positioned over an injector for injecting the coiled tubing within a well; said guide arm being mounted on said mounting device for pivotal movement on a side of the reel opposite said gooseneck.

6. The levelwind apparatus as set forth in claim 5 wherein said force exerting means is effective to move said arm and coiled tubing guide laterally back and forth between the ends of said reel during wrapping of the coiled tubing on the reel.

7. The levelwind apparatus as set forth in claim 6 wherein said coiled tubing guide is positioned rearwardly of the current coiled tubing wrap being wound a predetermined distance to provide a tight wrapping of the reel.

8. The levelwind apparatus as set forth in claim 6 wherein said force exerting means is effective to exert a predetermined force against said coiled tubing as the coiled tubing is being wrapped onto said reel.

9. A coiled tubing reel structure comprising:

a coiled tubing reel mounted for rotation about a horizontal axis;

drive means for rotating said coiled tubing reel;

a coiled tubing guide member adjacent said reel for guiding coiled tubing onto said reel; and fluid pressure means operatively connected to said coiled tubing guide member independently of said drive means for exerting a predetermined force against said guide member and coiled tubing guided thereby onto said reel;

wherein electrically actuated control valves are operatively connected to said fluid pressure means for actuation of said fluid pressure means and movement of said coiled tubing guide member to a desired position, and wherein a position sensor is operatively connected to said fluid pressure means for sensing the position of said coiled tubing guide member; and a microprocessor receives signals from said position sensor for processing and then transmits signals to said electrically actuated control valves to effect actuation of said fluid pressure means.

10. A coiled tubing reel structure as set forth in claim 9 wherein said electrically actuated control valves comprise solenoid operated control valves, and output signals from said microprocessor effect energizing of said solenoid operated control valves.

* * * * *